US010097915B2

(12) United States Patent
Beckhart

(10) Patent No.: US 10,097,915 B2
(45) Date of Patent: Oct. 9, 2018

(54) EARBUD STABILIZATION SYSTEM

(76) Inventor: Gordon Haggott Beckhart, Colorado Springs, CO (US)

( * ) Notice: Subject to any disclaimer, the term of this patent is extended or adjusted under 35 U.S.C. 154(b) by 115 days.

(21) Appl. No.: 12/837,702

(22) Filed: Jul. 16, 2010

(65) Prior Publication Data

US 2011/0170731 A1 Jul. 14, 2011

(51) Int. Cl.
*H04R 1/10* (2006.01)
*H04R 5/033* (2006.01)

(52) U.S. Cl.
CPC ..... *H04R 1/105* (2013.01); *H04R 5/0335* (2013.01); *H04R 1/1066* (2013.01)

(58) Field of Classification Search
USPC ..... 381/378
See application file for complete search history.

(56) References Cited

U.S. PATENT DOCUMENTS 6,186,362 B1 * 2/2001 Smith ..... B65D 35/285 222/102
2008/0298622 A1 * 12/2008 Lee ..... 381/378
2008/0310666 A1 * 12/2008 Wengreen ..... H04R 1/026 381/381
2009/0022352 A1 * 1/2009 Weibel ..... H04R 1/1066 381/378
2009/0073950 A1 * 3/2009 Guccione et al. ..... 370/341
2009/0123016 A1 * 5/2009 Rise ..... 381/380
2009/0226024 A1 * 9/2009 Dean ..... 381/379
2009/0285434 A1 * 11/2009 Williams ..... H04R 1/1091 381/375
2010/0124349 A1 * 5/2010 Bass ..... H04R 1/10 381/379

* cited by examiner

*Primary Examiner* — Christopher Uhlir
(74) *Attorney, Agent, or Firm* — The Law Office of Patrick F. O'Reilly III, LLC

(57) ABSTRACT

A system for earbud headphones holds the earbud headphone on during movement. The system has a "C" shaped ear frame with a first end and a second end. The first end has an opening. The ear frame is formed from a soft plastic. A clip has a concave side that mates with an earbud headphone. A pin is attached to the clip and detachably extends through the opening in the ear loop. The opening has a spherically concave shape with a hole in the center. The pin has a ball shaped head that mates with the spherically concave shape to form a ball and socket arrangement. As a result, the clip is able to rotate 360 degrees. The stem of the pin is smaller than the hole and this allows the clip holding the earbud speaker to tilt.

18 Claims, 2 Drawing Sheets

EARBUD STABILIZATION SYSTEM

RELATED APPLICATIONS

The present invention claims priority on provisional patent application Ser. No. 61/225,981, filed on Jul. 16, 2009, entitled "Earbud Support System" and is hereby incorporated by reference.

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

Earbud headphones or Earbud speaker style headset ("earbud headsets") have become very popular. This style headphone has speakers that fit inside the user's ear. Earbud headsets are supplied with most MP3 players. Unfortunately, earbud headsets often do not stay in the ear when the user moves or is active, such as jogging, skiing, or involved in other sporting activities. In fact, merely moving one's head can dislodge earbud headsets. Sport-style replacement earbud headsets are available, but they are expensive.

Thus there exists a need for an inexpensive earbud headphone system that stabilizes/supports/provides assistance to earbud headsets to stay in place when the user is moving/active, such as in sporting activities.

BRIEF SUMMARY OF INVENTION

A system for earbud headsets that holds the earbud headphone in place during physical movement. The system includes a frame/hook/loop/support, that may be shaped similar to an outline of an ear ("ear frame"). In an example embodiment, the ear frame having an approximate "C" shape with a first end and a second end. The first end has an opening. The ear frame is formed from a soft/moldable/flexible/bendable/movable ("soft") plastic/rubber which assist in comfort and staying connected to the ear. The system may further comprise a clip. The clip may be connected to earbud headsets using various methods well known in the art. For example the clip may have a concave side that connects with an earbud headphone. Further, the clip may have a pin, or similar connector, attached to the clip. The pin may further detachably extend through the opening in the ear frame. The opening, located at the first end, may have a spherically concave shape with a hole in the center. The pin may have a ball shaped head that connects with the spherically concave shape to form a ball and socket arrangement. As a result, the clip is able to rotate 360 degrees. The stem of the pin can be smaller than the hole allowing the clip holding the earbud speaker to tilt slightly. This tilt, rotation, or movement provides more comfort to the user by allowing the earbud system to, in essence, mold/shape to an individual's ear.

In the example embodiment, the user snaps the speakers of their earbud headsets to the clips of their earbud stabilization system. The ear frames are then placed over the user's ears. The system is inexpensive because it does not replace the user's existing earbud headsets, but works with them. The ball and socket make the system extremely comfortable and the ear frames ensure that the speakers do not fall out of the user's ear.

DETAILED DESCRIPTION OF THE INVENTION

The invention relates to a system and method for earbud headsets that stabilizes the earbud headphone during movement, such as sporting activities. The system includes a frame to go over one's ear, that may be shaped similar to an outline of an ear ("ear frame"). In an example embodiment, the ear frame having an approximate "C" shape with a first end and a second end. The first end has an opening. The ear frame may be formed from a soft plastic/rubber which assist in comfort and staying connected to the ear. The system or method may further comprise a clip. The clip may be connected to earbud headsets using various methods well known in the art. In an example embodiment, the clip may have a concave side that connects with an earbud headphone. Further, the clip may have a pin, or similar connector, attached to the clip. In this example embodiment, the pin detachably extends through the opening in the ear frame. The opening has a spherically concave shape with a hole in the center. The pin may have a ball shaped head that mates/connects with/to the spherically concave shape to form a ball and socket arrangement. As a result, the clip is able to rotate 360 degrees. The stem of the pin can be smaller than the hole allowing the clip holding the earbud speaker to tilt slightly. This tilt or movement provides more comfort to the user by allowing the earbud system to, in essence, mold to an individual's ear In an example embodiment, the user snaps/attaches the speakers of their earbud headsets to the clips of their earbud stabilization system. The ear frames are then placed over the user's ears. The system is inexpensive because it does not replace the user's existing earbud headsets, but works with them and stabilizes/supports them. In the example embodiment, the ball and socket make the system extremely comfortable and the ear frames ensure that the speakers do not fall out of the user's ear.

Figure 1:
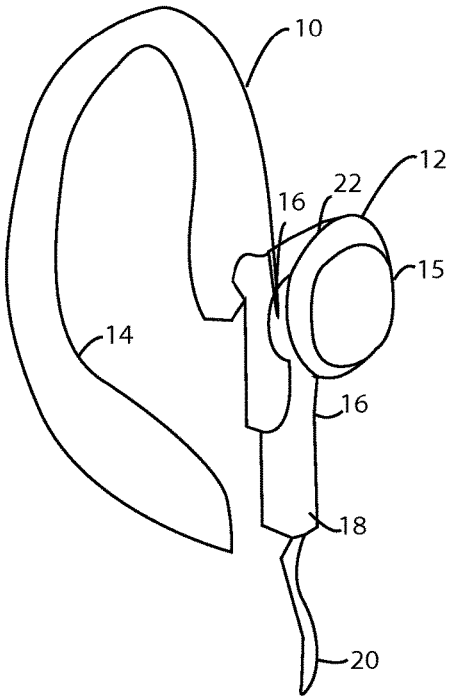
FIG. 1 is a perspective view of an earbud stabilization system and earbud speaker in accordance with one embodiment of the invention.

FIG. 1 is a perspective view of an earbud stabilization system 10 and earbud speaker 12 in accordance with one embodiment of the invention. The earbud system 10 include a ear frame 14 and a clip 16 that attached to the earbud headphone speaker 15. The earbud speaker 15 has housing 16 that includes a stem 18 that connects to an electrical cord 20 and speaker portion 22.

Figure 2:
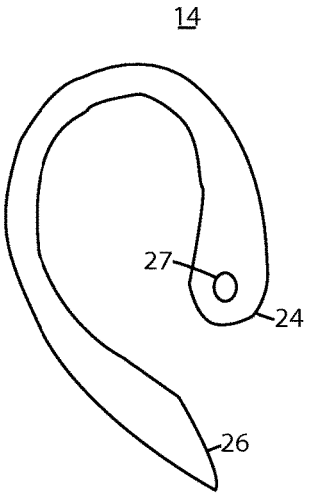
FIG. 2 is a front view of an ear frame in accordance with one embodiment of the invention.

FIG. 2 is a front view of an ear frame 14 in accordance with one embodiment of the invention. The ear frame 14 may be "C" shaped or may be described as a spiral shape extending slightly beyond 360 degrees. The ear frame 14 has a first end 24 and a second end 26. The first end 24 has an opening (aperture) 27. The ear frame is made of a soft plastic/rubber in one embodiment.

Figure 3:
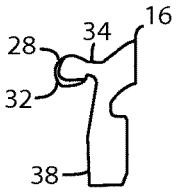
FIG. 3 is a side view of a clip in accordance with one embodiment of the invention.

FIG. 3 is a side view of a clip 16 in accordance with one embodiment of the invention. The clip 16 has a pin 28 extending from a convex side 30 of the clip 16. The pin 28 has a head in shape of a ball 32 at the end of a stem 34.

Figure 4:
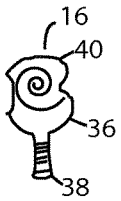
FIG. 4 is a front view of the clip in accordance with one embodiment of the invention.

FIG. 4 is a front view of the clip 16 in accordance with one embodiment of the invention. This figure shows the concave side 36 of the clip. The first end 38 of the clip 16 connects (mates) with a stem 18 of the earbud speaker housing. The second end 40 connects (mates) with a speaker portion 22 of the earbud speaker housing.

Figure 5:
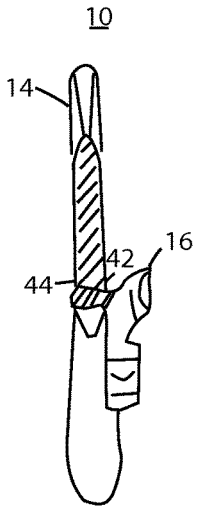
FIG. 5 is a cross sectional view of an earbud stabilization system in accordance with one embodiment of the invention.

FIG. 5 is a cross sectional view of the earbud stabilization system 10 in accordance with one embodiment of the invention. This cross sectional view shows how the clip 16 connects to the ear frame 14. The pin 28 is pushed through the opening 27 of the ear frame 14. The opening 27 has a first side 42, which is a flat circular opening—see FIG. 2. The other side 44 of the opening 27 is in the form of a socket or spherical concave surface. The ball 32 of the pin and the socket 44 of the ear frame 14 form a ball and socket arrangement that allows the clip 16 to rotate freely. In addition, the width of the step 34 of the pin 28 is smaller than the flat circular opening 42. This allows the clip 16 to tilt slightly. In one embodiment, the clip may be attached in another manner. For instance, it may not be a ball and socket arrangement, it may be formed as part of the ear frame, or some other well known attachment system may be used without departing from the invention.

In operation, the user snaps the speakers of their earbud headset headphones to the clips of their earbud stabilization system. The ear frame is then placed over the user's ear. The system is inexpensive because it does not replace the user's existing earbud headset, but works with them. The ball and socket make the system extremely comfortable and the ear frames ensure that the earbud headsets do not fall out of the user's ear.

Figure 6:
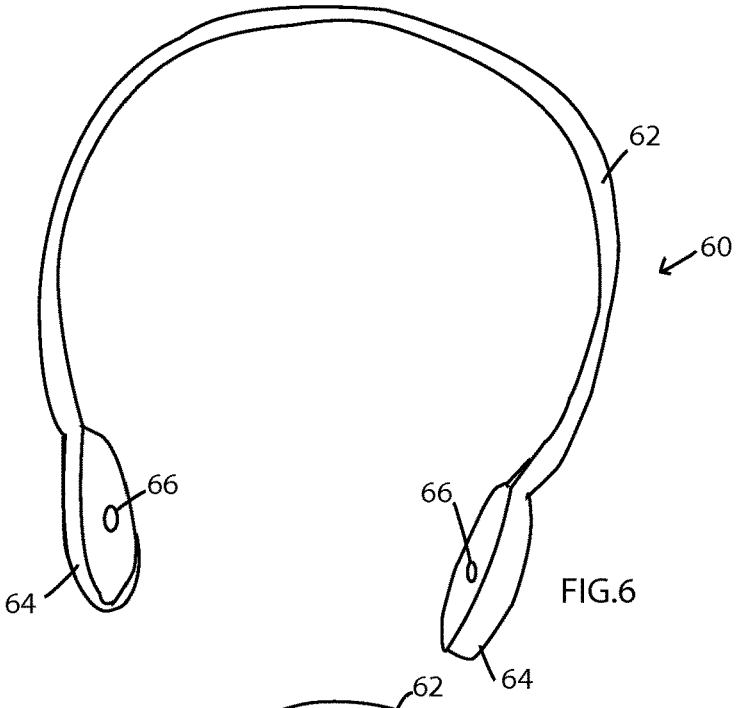
FIG. 6 is a front view an earbud stabilization system in accordance with one embodiment of the invention.
Figure 7:
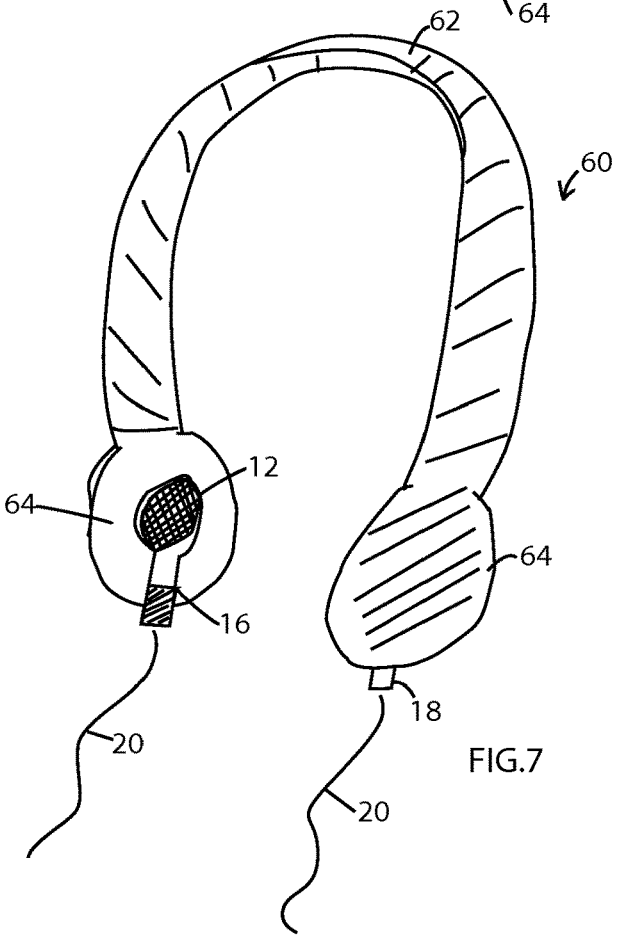
FIG. 7 is a perspective view an earbud stabilization system in accordance with one embodiment of the invention.

FIG. 6 is a front view of an earbud stabilization system 60 in accordance with one embodiment of the invention. In this embodiment, a headband 62 has a pair of ear covers 64. The ear covers 64 have an opening 66 that accepts the pin 28 of the clip 16 shown in FIG. 3. FIG. 7 is a perspective view of an earbud stabilization system 60 in accordance with one embodiment of the invention. This figure shows the earbud speaker 12 attached to the clip 16, which is attached to the ear cover 64. The embodiment of the earbud stabilization system 60 shown in FIGS. 6 & 7 allows the user to use a headband 62 to hold the earbud speakers 12 instead of ear frames 14.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. An earbud stabilization system, comprising:

an ear frame shaped to go over a user's ear having a C-shape, the ear frame defining an aperture to accept a pin, wherein the aperture extends through both sides of the ear frame;

an earbud headphone including a speaker portion and a stem portion, the speaker portion of the earbud headphone having a greater width than the stem portion of the earbud headphone;

a clip including a stem holding portion and a speaker holding portion, the clip being flared outwardly at the speaker holding portion, the stem holding portion of the clip connecting with the stem portion of the earbud headphone, and the speaker holding portion of the clip forming a concave cavity that receives the speaker portion of the earbud headphone; and the pin integrally formed with the clip and detachably extending through the aperture in the ear frame; wherein the stem holding portion of the clip comprises a longitudinally extending opening facing an ear of a user when the system is disposed on the ear of the user.

2. The system of claim 1, wherein the ear frame has a first end, the first end having the aperture comprising a side with the shape of a socket.

3. The system of claim 1, wherein a head of the pin is in the shape of a ball.

4. The system of claim 1, wherein the clip is allowed to rotate in a ball and socket arrangement.

5. The system of claim 2, wherein a stem of the pin is smaller than the aperture in the ear frame, thereby allowing the clip to tilt.

6. The system of claim 1, wherein the stem holding portion is disposed at a first lower end of the clip, and the speaker holding portion is disposed at a second upper end of the clip.

7. The system of claim 1, wherein the ear frame is formed from a flexible plastic material.

8. The system of claim 1, wherein the stem holding portion of the clip is spaced apart from the speaker holding portion of the clip by a notch.

9. An earbud stabilization system, comprising:

an ear frame having a C-shape shaped to go over one's ear; and a clip having an attachment point to a first end of the C-shape, the clip configured to support an earbud headphone that includes a speaker portion and a stem portion that is narrower in width than the speaker portion, the clip having a stem holding portion and a speaker holding portion, the clip being flared outwardly at the speaker holding portion, the stem holding portion of the clip configured to connect with the stem portion of the earbud headphone, and the speaker holding portion of the clip forming a concave cavity that is configured to receive the speaker portion of the earbud headphone, where the attachment point includes a pin integrally formed with the clip and extending opposite the concave cavity; wherein the stem holding portion of the clip comprises a longitudinally extending opening facing an ear of a user when the system is disposed on the ear of the user.

10. The system of claim 9, wherein the clip is detachably connected to the ear frame.

11. The system of claim 9, wherein the ear frame has an opening at the first end, wherein the opening extends through the ear frame.

12. The system of claim 11, wherein the opening has a first side and a second side, the second side forming a spherical concave surface.

13. The system of claim 12, wherein the first side has a flat circle opening.

14. The system of claim 13, wherein the pin has a head in the shape of a ball.

15. The system of claim 9, wherein the clip is allowed to rotate in a ball and socket arrangement.

16. The system of claim 14, wherein a stem of the pin is smaller than the flat circle opening in the ear frame, thereby allowing the clip to tilt slightly.

17. The system of claim 9, wherein the ear frame is formed from a flexible plastic material.

18. The system of claim 9, wherein the stem holding portion of the clip is spaced apart from the speaker holding portion of the clip by a notch.

* * * * *